US007395636B2

(12) United States Patent
Blomberg

(10) Patent No.: US 7,395,636 B2
(45) Date of Patent: Jul. 8, 2008

(54) SKYLIGHT

(76) Inventor: Jerome Blomberg, 6201 27th St., Sacramento, CA (US) 95822

( * ) Notice: Subject to any disclaimer, the term of this patent is extended or adjusted under 35 U.S.C. 154(b) by 0 days.

(21) Appl. No.: 10/620,673

(22) Filed: Jul. 15, 2003

(65) Prior Publication Data

US 2004/0049996 A1 Mar. 18, 2004

Related U.S. Application Data

(60) Provisional application No. 60/396,193, filed on Jul. 15, 2002.

(51) Int. Cl.
*E04D 13/03* (2006.01)

(52) U.S. Cl. ..... 52/200; D25/52; D26/122; 359/591

(58) Field of Classification Search ..... 52/200, 52/72; 47/29.1, 29.2, 17, 60, 61, 69; 359/592–594, 359/591, 596, 597; D11/145, 155; D25/54, D25/18, 26, 29, 52; D26/120, 122
See application file for complete search history.

(56) References Cited

U.S. PATENT DOCUMENTS

| | | | | | |
|---|---|---|---|---|---|
| 994,924 | A | * | 6/1911 | Hutton | 359/597 |
| 1,156,251 | A | * | 10/1915 | Shuman | 52/395 |
| 1,888,522 | A | * | 11/1932 | Ward | 49/86.1 |
| 1,921,303 | A | * | 8/1933 | Raschka | 52/200 |
| 2,175,653 | A | * | 10/1939 | Williams | 52/277 |
| 2,280,647 | A | * | 4/1942 | Hawes | 52/200 |
| D134,481 | S | * | 12/1942 | Borkland | D26/122 |
| 2,444,420 | A | | 7/1948 | Borkland | |
| D158,193 | S | * | 4/1950 | Hood | D26/122 |
| D165,256 | S | * | 11/1951 | Yellin | D9/425 |
| 2,842,073 | A | * | 7/1958 | Huston et al. | 52/200 |
| 2,874,653 | A | | 2/1959 | Ratner | |
| 2,982,054 | A | * | 5/1961 | Anderson | 52/82 |
| D196,382 | S | * | 9/1963 | Schwartz | D26/122 |
| 3,232,014 | A | | 2/1966 | Frost | |
| 3,561,057 | A | | 2/1971 | Butzko | |
| 3,577,691 | A | * | 5/1971 | Persson et al. | 52/72 |
| 3,665,661 | A | * | 5/1972 | Beckerer | 52/19 |
| 3,674,620 | A | * | 7/1972 | McCarthy et al. | 428/114 |
| 3,721,053 | A | * | 3/1973 | Geyser | 52/82 |
| 3,762,120 | A | * | 10/1973 | Janssen | 52/200 |
| 4,103,059 | A | * | 7/1978 | Kautz | 428/178 |
| 4,114,330 | A | | 9/1978 | Sukolics | |
| 4,184,480 | A | * | 1/1980 | Kenny | 126/704 |
| 4,186,723 | A | * | 2/1980 | Coppola et al. | 126/570 |

(Continued)

FOREIGN PATENT DOCUMENTS

| | | | |
|---|---|---|---|
| CH | 418589 | * | 2/1967 |

(Continued)

*Primary Examiner*—Robert Canfield

(57) ABSTRACT

A skylight having an arched main body, an apex, a base, and corrugations is described. The main body has two lengths, the first being at substantially the apex and the second at the base wherein the first length is less than the second length. The skylight also has a first end portion and a second end portion at opposing ends of the main body, each of which has a top and bottom section. The distance between the top sections define the first length and the distance between the bottom sections defines the second length. The corrugations disposed on the main body vary by orientation, method of manufacture, number, and shape.

6 Claims, 9 Drawing Sheets

U.S. PATENT DOCUMENTS 4,222,196 A * 9/1980 Pointon ..... 47/29.1
4,236,350 A * 12/1980 Hasselbach, Sr. ..... 47/17
4,283,451 A * 8/1981 Abrahami ..... 428/182
4,291,494 A * 9/1981 Knablein et al. ..... 47/17
D262,492 S * 12/1981 Mackes ..... D25/54
4,330,500 A 5/1982 Mackes
D264,695 S 6/1982 Mackes
4,344,261 A 8/1982 Weisner et al.
4,428,169 A 1/1984 Tsakiris
4,428,358 A 1/1984 Adamson
D273,045 S * 3/1984 Artwick ..... D25/54
4,447,200 A 5/1984 Weisner et al.
4,475,536 A 10/1984 Dame
4,519,675 A * 5/1985 Bar-Yonah ..... 359/595
4,549,379 A 10/1985 Hoy et al.
4,636,348 A 1/1987 Whiteside
4,674,972 A 6/1987 Wagner
4,692,111 A 9/1987 Wagner
4,825,608 A * 5/1989 Makin ..... 52/200
4,884,379 A 12/1989 McCabe
5,419,090 A * 5/1995 Sandow ..... 52/200
5,427,732 A 6/1995 Shuert
D374,087 S 9/1996 Eijadi et al.
5,648,873 A * 7/1997 Jaster et al. ..... 359/591
5,655,339 A 8/1997 DeBlock et al.
5,715,634 A * 2/1998 Schultz ..... 52/200
5,795,535 A 8/1998 Giovannone et al.
5,896,712 A * 4/1999 Chao ..... 52/200
5,958,326 A 9/1999 Caferro
5,983,581 A * 11/1999 DeBlock et al. ..... 52/200
6,086,800 A 7/2000 Manlove
6,178,707 B1 1/2001 Bengtson
6,363,667 B2 4/2002 O'Neill
6,438,910 B1 8/2002 Erskine
6,484,455 B1 11/2002 Poole
RE38,217 E * 8/2003 DeBlock et al. ..... 52/200
D489,462 S * 5/2004 Blomberg ..... D25/52

FOREIGN PATENT DOCUMENTS

DE 004233380 A1 * 4/1994
EP 000576062 A1 * 12/1993
GB 2069036 A * 7/1981
WO WO 92/02697 * 2/1992
WO WO 97/33735 9/1997

* cited by examiner 20
50
14
38
34
40
26
51
16
22
24
18
17
28
30
36

SKYLIGHT

CROSS REFERENCE TO RELATED APPLICATIONS

This application claims the benefit of provisional application number 60/396,193 which was filed on Jul. 15, 2002 and which is incorporated herein by reference.

BACKGROUND OF THE INVENTION

1. Field of the Invention

The present invention relates to the field of skylights.

2. Description of Related Art

Conventional skylights are typically made of light-transmitting plastic or glass, and have either a planar, tubular, pyramidal, or domed shape.

Skylights are commonly inserted into the roofs of buildings to introduce natural light into the interior of buildings to offset the need for artificial light. Another use for skylights is to permit heat to escape the building.

An example of a typical skylight is a dome-shaped skylight having a 10% rise. Other examples are planar skylights, essentially horizontal windows that may or may not open, and tubular skylights that reflect light down through their tubes and into the rooms below. Examples of a planar skylight are provided by U.S. Pat. Nos. 2,874,653 and 4,428,358. Examples of tubular skylights are provided by U.S. Pat. Nos. 5,655,339 and 6,178,707.

All of these conventional skylights have inefficiencies and short comings.

SUMMARY OF THE INVENTION

It is preferred that skylights perform their functions as efficiently as possible and be sturdy enough to withstand the weather and other forces imposed upon them. The ability of skylights to collect light essentially depends on three factors: the amount of skylight surface area exposed to the incoming light, the angle of that surface area relative to the incoming light, the optical transparency of the material used to manufacture the skylight. The ability of skylights to dissipate heat is a function of the material used to manufacture the skylight and the surface area of the skylight.

A common dome skylight 800 is shown in FIG. 23 and is used to demonstrate the inefficiencies of conventional skylights. As seen in FIG. 23, the surface area of dome skylight 800 is simply the cumulative area of its smooth curved surface 802. This minimal surface area limits the ability of domed surface 802 to collect sunlight and dissipate heat.

FIG. 23 further shows that a large portion of dome skylight 800 is orientated away from incoming low-angle light, represented by arrows 804, and, therefore, receives little of light 804 directly. This results because a significant amount of light 804 is reflected off surface 802. The Law of Reflection states that the angle of incidence of a ray of light, i.e., the angle at which a light ray strikes a planar surface, is its angle of reflection. A ray of light that strike a surface at less than 90 degrees reflects off the surface at the same angle at which it struck the surface. It follows that the higher the angle of incidence, the less light is reflected off the surface. Accordingly, during those times when the light source, i.e. the sun in most circumstances, is at a relatively angle such as about 18 degrees, relative to a base 808 of skylight 800, the angle of incidence 809 of light 804 to surface 802 will also be relatively low. Thus, because angle 809 is relatively low, much of light 804 is reflected off surface 802. The reflected light is represented by arrows 806. Because a large amount of light 804 is reflected during these instances, only minimal amounts of light 810 is transmitted through the surface 802 and into the area sought to be illuminated.

Dome skylights inserted into the roofs of buildings are often exposed to harsh elements such as hail and heavy snow. Such skylights also pose a significant safety risk to those persons performing maintenance or other tasks on those roofs. As a result, dome skylights are commonly composed of light-transmitting material that is quite thick or provided with protective bars surrounding or inserted into the skylights. These additional features diminish the light transmittance of the skylights and increase the cost of their manufacture.

The present invention, however, provides for an improved skylight. The surface area of the skylight is increased by having corrugations disposed on an arched main body. This arched and corrugated structure increases the strength of the skylight. This structure also permits the skylight to be made with thinner material than conventional skylights, thereby providing for more efficient heat transfer. The skylight also has two end portions that are angled toward the midline of the main body. These end portions have the ability to collect light that originates from light sources nearly perpendicular relative to the base of the skylight. Additionally, these end portions and corrugations are angled so as to increase the angle of incidence of the light striking their surfaces. This increased angle of incidence results in a high angle of reflection and, consequently, little light is reflected off those surfaces. In sum, the present invention overcomes the shortcomings of the prior art.

The present invention provides an improved skylight having an arched main body. The main body has an apex and a base and has two lengths, the first being at substantially the apex and the second at the base. The first length is less than the second length. The skylight of the present invention also has a first end portion and a second end portion at each end of the main body. These end portions have top sections and bottom sections. The top sections of the end portions define the first length and the bottom sections of the end portions define the second length. The main body also has two or more corrugations.

The present invention further provides a window having an arched main body and having first and second ends and a midpoint. The skylight of the present invention also has a first end portion and a second end portion at each end of the main body wherein at least a section of at least one of the end portions slopes toward the midpoint of the main body. The skylight of the present invention also has a plurality of corrugations disposed on the main body.

The present invention further provides an improved skylight having a main body being arched along its longitudinal axis and having an apex, a base, a midpoint, a first length at substantially the apex and a second length at the base, wherein the first length is less than the second length. The skylight of the present invention also has first and second end portions being substantially planar, integral to the main body, and disposed at first and second ends of the main body, respectively, wherein each of the end portions slopes toward the main body at substantially 45 degrees relative to the base and having a top section and a bottom section, wherein the top sections define the first length and the bottom sections define the second length. The skylight of the present invention also has a plurality of corrugations disposed on the main body orientated perpendicular to the longitudinal axis of the main body. It should be understood that the term skylight, as used herein, does not necessarily include a frame used to attach the skylight to another structure such as the roof of a building or the like. It should further be understood that the term window can e also be used to identify the present invention.

These and other features and advantages of this invention are described in, or are apparent from, the following detailed description of various exemplary embodiments of the devices according to this invention.

BRIEF DESCRIPTION OF THE DRAWINGS

Various exemplary embodiments of this invention will be described in detail, with reference to the following figures, wherein.

DETAILED DESCRIPTION OF THE PREFERRED EMBODIMENT

Figure 21:
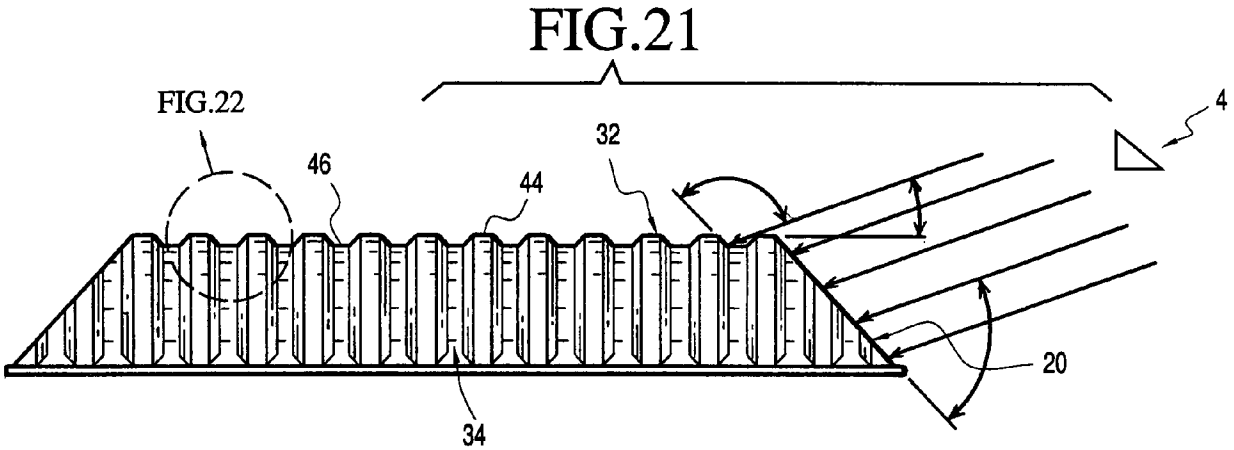
FIG. 21 is the same side view of the skylight shown in FIG. 3, displayed with representative light rays.
Figure 22:
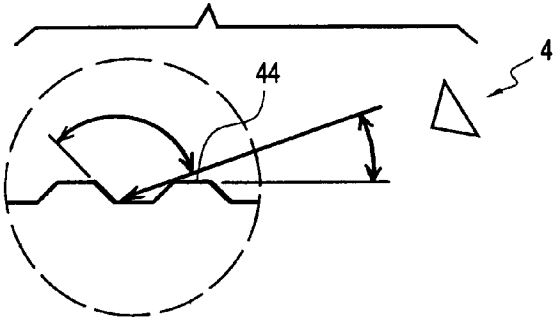
FIG. 22 is a blown-up detailed view of corrugations shown in FIG. 1.
Figure 23:
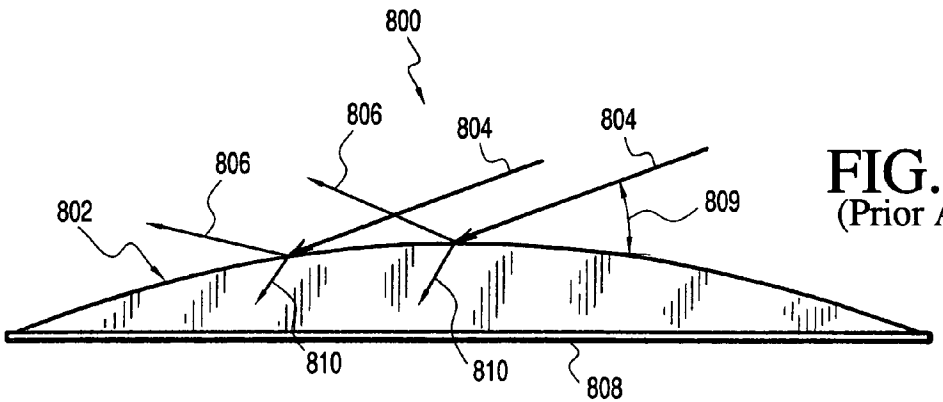
FIG.23 (Prior Art)
FIG. 23 is a side view of a prior art dome-shaped skylight.

FIGS. 1-5, as well as FIGS. 21 and 22, show an exemplary embodiment of a skylight 10 made in accordance with this invention. Skylight 10 includes a main body 12, a first end portion 20, a second end portion 26, and corrugations 32.

Main body 12 is arched and has a base 34 and an apex 36. Main body 12 is arched along its longitudinal axis 18. It should be appreciated that in other exemplary embodiments the main body is arched along an axis substantially perpendicular to its longitudinal axis. Main body 12 is arched in the shape of a curve. It is preferred that main body 12 be arched in the shape of a parabola. In other various exemplary embodiments of the invention, the main body is arched in other shapes, such as, for example an A-frame shape or in a continues curve. Main body 12 arches from base 34 and reaches its maximum height at apex 36.

Main body 12 further includes a first length 38 and a second length 40. It should be appreciated that the main body is comprised of, in various exemplary embodiments, multiple layers of materials. These multiple layers are, in further exemplary embodiments, separated by a gap filled with a vacuum or air or other gases.

Apex 36 spans those points along the tangential plane of main body 12 furthest from base 34. Apex 36 can have any height from base 34 that permits the skylight to have end portions 13, 16 angled toward the midpoint 17 of main body 12.

Figures 2, 3, 4:
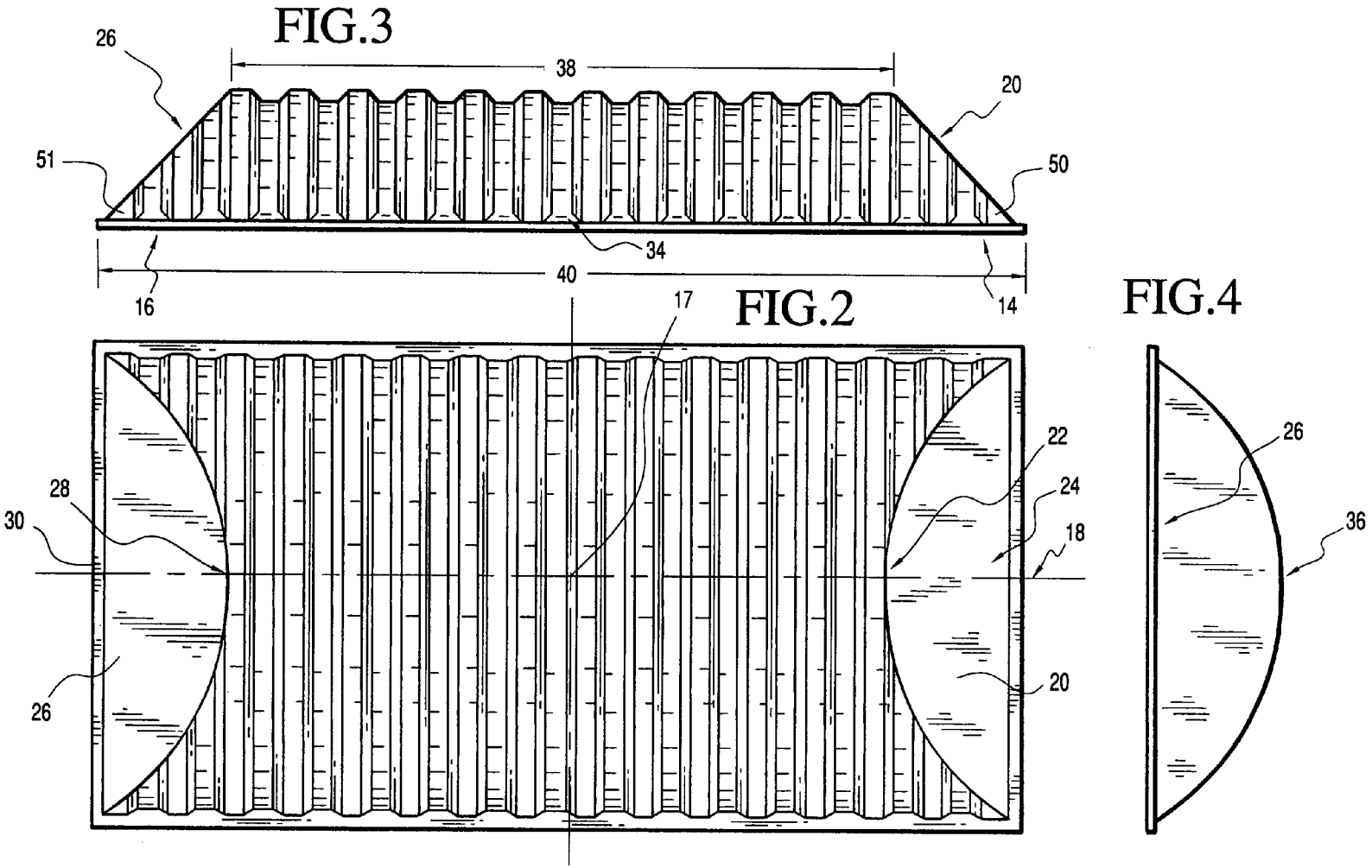
FIG. 2 is a top view of the sunlight collection device shown in FIG. 1.
FIG. 3 is a side view of the sunlight collection device shown in FIG. 1.
FIG. 4 is an end view of the sunlight collection device shown in FIG. 1, specifically showing a second end portion.
Figure 5:
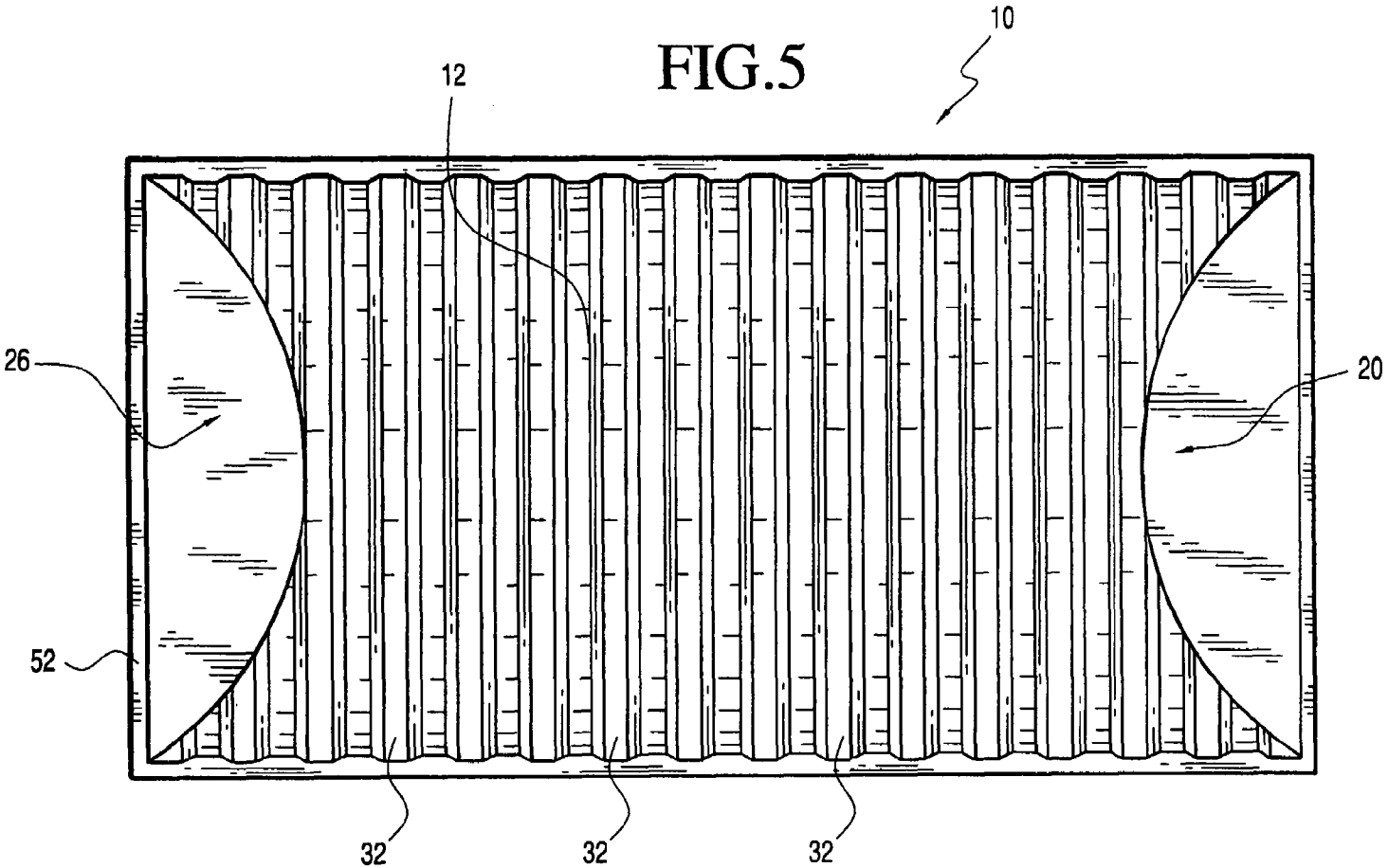
FIG. 5 is a bottom view of the skylight shown in FIG. 1.

Base 34 can have any dimension. The dimensions of base 34 are determined by the space available on the structure to which, or into which, the skylight will be attached. In one example of the preferred embodiment, base 34 has dimensions that form a rectangle as is shown in FIG. 3. It should be appreciated that the base has, in various other exemplary embodiments, dimensions that do not form a rectangle but rather form other shapes, such as an oval.

Main body 12 also has a flange 52. Flange 52 is used to attach skylight 10 to a frame or the like. Skylight frames may not, however, require a flange. It should be appreciated, therefore, that in various alternative embodiments the main body does not have a flange. Flange 52 is located along the entire perimeter of skylight 10. Flange 52 extends from base 34 and both end portions 20, 26 substantially perpendicular relative to longitudinal axis 18. Flange 52 is integral to main body 12 and is approximately 1½ inches in length in a preferred embodiment. It should be further appreciated that in still more embodiments of the present invention, the flange is not located on the entire perimeter of the base of the main body. In an example of one of these alternative embodiments, the base of the main body has two flanges that are cumulatively sufficient to secure the skylight to a frame.

First end portion 20 and second end portion 26 are located at opposing ends of main body 12. End portions 20 and 26 can have any shape. In FIG. 2 both end portions 20, 26 are shown as being generally planar. It should be appreciated that in alternative embodiments, the end portions are not planar and are, for example, curved or rippled. In further alternative embodiments, the end portions have corrugations attached or formed from the material comprising the end portions. In alternative embodiments, the end portions are integral to the material comprising the main body. In still other alternative embodiments the end portions are made independent from the main body and are thereafter attached to the main body.

End portions 20 and 26 are angled toward the midpoint 17 of main body 12. It is preferable that each of the end portions be angled at 45 degrees relative to base 34. This orientation is shown on FIG. 3 by a first end portion angle 50 and a second end portion angle 51. It should be appreciated, however, that the end portion angles need not be 45 degrees. The end portion angles are about, in various exemplary embodiments, between 15 and 85 degrees. In further exemplary embodiments, the end portion angles are between about 25 and about 75 degrees. In still further exemplary embodiments, the end portion angles are between about 35 and about 65 degrees. Alternative embodiments of the present invention have end portion angles that are not the same. For example, in one alternative embodiment, the first end portion angle is angled inward at 75 degrees and the second end portion angle is angled inward at 35 degrees.

End portions 20 and 26 each have top sections 22 and 28, respectively, and bottom sections 24 and 30, respectively. First length 38 of main body 12 is defined by the distance between top section 22 of first end portion 20 and top section 28 of second end portion 26. Second length 40 of main body 12 is defined by the distance between bottom section 24 of first end portion 20 and bottom section 30 of second end portion 30.

Corrugations 32 are orientated perpendicular to longitudinal axis 18. It should be appreciated that the corrugations are, in various exemplary embodiments, orientated parallel to or skewed to the longitudinal axis of the main body. One such alternative embodiment has corrugations that are orientated parallel to the longitudinal axis. It should be further appreciated that not all of the corrugations are, in various other exemplary embodiments, orientated along the same axes. One such alternative embodiment has a number of corrugations orientated along the longitudinal axis and a number orientated at 45 degree angles relative to the base. The orientation of these corrugations in various exemplary embodiments has ornamental aspects.

Figure 1:
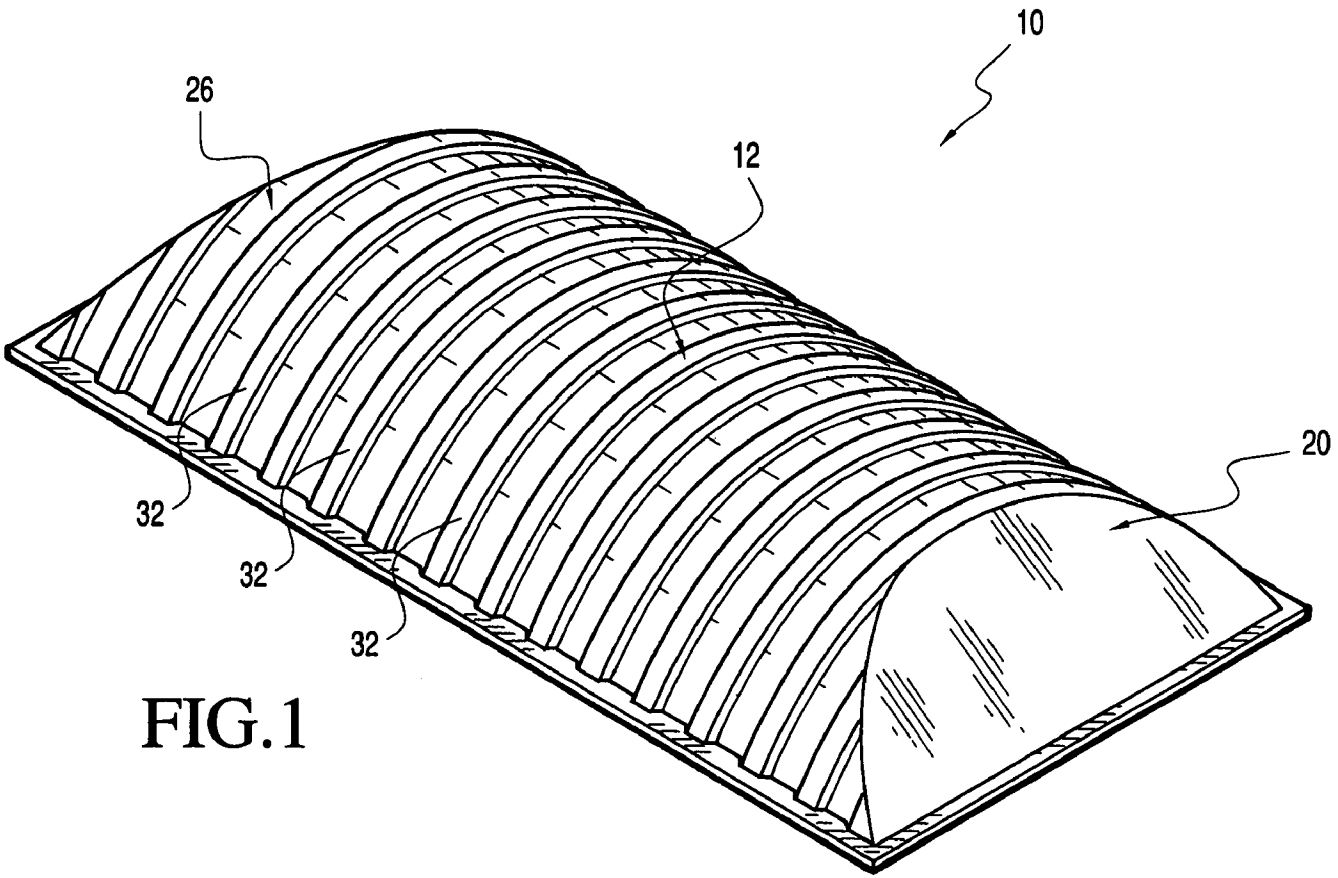
FIG. 1 is a perspective view of the sunlight collection device according to an exemplary embodiment of the present invention.

Corrugations 32 are integral to main body 12. However, in alternative embodiments, the corrugations are formed independently and are thereafter attached to the main body. Main body 12 has two or more corrugations 32. FIG. 1 shows an example of the preferred embodiment having 12 corrugations for a main body that has a second length of about six feet. Similar to the orientation of the corrugations, the number of corrugations to use when constructing the skylight involves ornamental considerations as well as functional ones.

Corrugations 32 can have any shape that rises above main body 12. One example of an exemplary embodiment has sinusoidal shaped corrugations. It should be appreciated that the corrugations are, in various other exemplary embodiments, other shapes such as semi-hexagonal or A-frame shaped. It is preferred that the corrugations have a hexagonal shape. As shown in FIGS. 21 and 22, one example of the preferred embodiment has semi-hexagonal corrugations 32 formed by 45 degree angles inwardly sloped toward the midpoint of corrugations 32. Additionally, in other embodiments of the invention, the corrugations have ridges, prisms, and other structures attached to, or formed from, the sides of the corrugations. Adjacent corrugations 32 form troughs 46.

It is often preferable to maximize the surface area of the skylight. Generally, the surface area of the skylight increases as more corrugations are disposed on the main body. To maximize the skylight surface area the largest number of corrugations as possible are disposed on the main body while still permitting incoming light to directly strike (i.e. strike at substantially 90 degrees relative to the surface), all the light-orientated corrugation surfaces. FIGS. 2, 3, 5, and 21 show an example of one embodiment that maximizes the surface area of skylight 10. In this example, main body 12 has twelve corrugations 32. Every corrugation 32 is semi-hexagonally-shaped (i.e. it has three sides of a hexagon). It is preferred that a corrugation 32 have two planar sides and further planar corrugation top surface 44.

In an actual reduction to practice of the exemplary embodiment, shown in FIGS. 1-5 and 21, the second length of the main body is approximately six feet long and there are 12 corrugations within the first length. In the reduction to practice, the sides of the corrugations were 1 inch in length and the top corrugation surface was 2 inches in length. Further, the troughs were 2 inches long. When this example of the preferred embodiment was exposed to low-angle light, it was capable of collecting more of that light than conventional skylights.

End portion 20 or 26, depending on which is orientated toward the light source, is available to capture the low-angle light that originates from a light source 4 parallel to or slightly above the longitudinal plane created by base 34. This is shown in FIG. 21. In addition, when light source 4 is approximately 18 degrees above the longitudinal plane formed by base 34, the light strikes the sides of all corrugations 32 that are orientated toward light source 4. This is shown in FIG. 22.

Any or all portions of skylight 10 can be made from any light-transmitting material capable of maintaining the structural integrity of the skylight. It is preferred that the light-transmitting material be thermoformable plastic. It should be appreciated that the light-transmitting material is, in various exemplary embodiments, composed of various formulations of plastic. It should be further appreciated that in still other exemplary embodiments, modifications are made to the light-transmitting material, such as the addition of pigments or the like. In yet another exemplary embodiment, prismatic plastic is used to form part or all of the skylight. Prismatic plastic has small raised structures within the plastic, each of which refracts the collected light into the area illuminated. The present invention does not require that all of the skylight be made from light-transmitting material. There are embodiments of the present invention, for example, where at least one of the end portions and the main body is made from material that does not transmit light or is designed to diffuse the light. Similarly, there are embodiments of the present invention where the main body and/or the end portion(s) are made of material that has varying degrees of light-transmitting ability. FIG. 21 shows an example of one embodiment wherein first end portion 20 and corrugations 32 are comprised of light-transmitting material.

The increased light collection efficiency of this invention has been demonstrated. One example of the preferred embodiment of the present invention, the "Signature" skylight shown in FIGS. 1-5 and 21, was experimentally shown to capture significantly more early morning, low-angle sunlight than two conventional skylights, manufactured by Bristolite and Tristar, respectively. The Bristolite skylight tested was a conventional domed skylight. The Tristar skylight was an low-arched skylight. Light meter readings were taken between 7:10 a.m. and 7:30 a.m. on the floor of a warehouse where the only source of natural light into the warehouse was from one four foot by eight foot opening in the roof twenty feet from the warehouse floor. The opening was covered by each of the four devices in a series of tests in which two measurements at nine separate points on the warehouse floor were taken. It took approximately two minutes to record each of the 18 readings. The two measurements at each point for each device were averaged. The results are shown below:

| Points | Bristo-lite | Tristar | Signature | % More Light Transmitted by Signature than Bristolite | % More Light Transmitted by Signature than Tristar |
|---|---|---|---|---|---|
| 1 | 5.5 | 6.4 | 10 | 82% | 56% |
| 2 | 8.3 | 9.9 | 15.4 | 86% | 56% |
| 3 | 3.7 | 4.6 | 6.7 | 81% | 46% |
| 4 | 4.8 | 6 | 7.6 | 58% | 27% |
| 5 | 2 | 2.2 | 2.9 | 45% | 32% |
| 6 | 4 | 4.6 | 5.8 | 45% | 26% |
| 7 | 3 | 3.4 | 4.4 | 47% | 29% |
| 8 | 6.5 | 8.1 | 10.6 | 63% | 31% |
| 9 | 11.5 | 14.8 | 19 | 65% | 28% |
| Total | 49.3 | 60 | 82.4 | 67% | 37% |

This experiment demonstrates that the "Signature" embodiment of the present invention collects significantly more low-angle sunlight than the two conventional domed skylights.

The skylight made in accordance with this invention is sturdier than conventional skylights. Its increased strength is a result of its arch shape in combination with its corrugations. As has been experimentally demonstrated by the applicant, this structure permits the present invention to be thinner than conventional skylights and yet still withstand, without breaking, a 200 pound weight dropped from a distance of 2 feet. One practical consequence of this advantage is that the skylight does not need protective bars surrounding it or inserted into it when used on the roofs of buildings where maintenance persons work. The skylight structure also increases the surface area of the skylight by combining the light collection ability of its angled end portions with the light collection ability of its angled corrugations. The result, as has been demonstrated, significantly increases its efficiency over existing skylights. The increased surface area also increases the heat transfer aspects of the skylight made in accordance with the present invention. Furthermore, the skylight structure limits debris from accumulating around the skylight when it is inserted into the roof of buildings and has proven to be aesthetically appealing to consumers.

Figure 8:
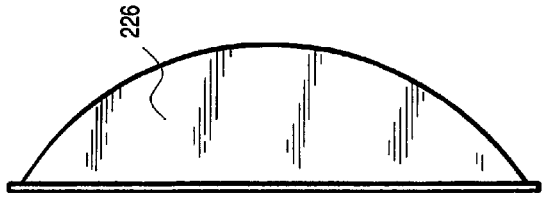
FIG. 8 is an end view of the skylight of FIG. 6.
Figure 7:
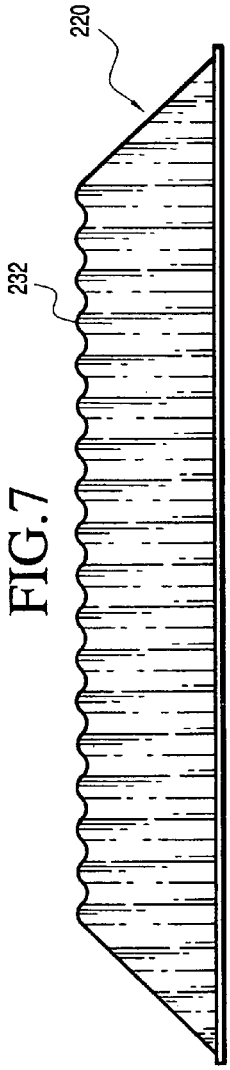
FIG. 7 is side view of the skylight of FIG. 6.
Figure 6:
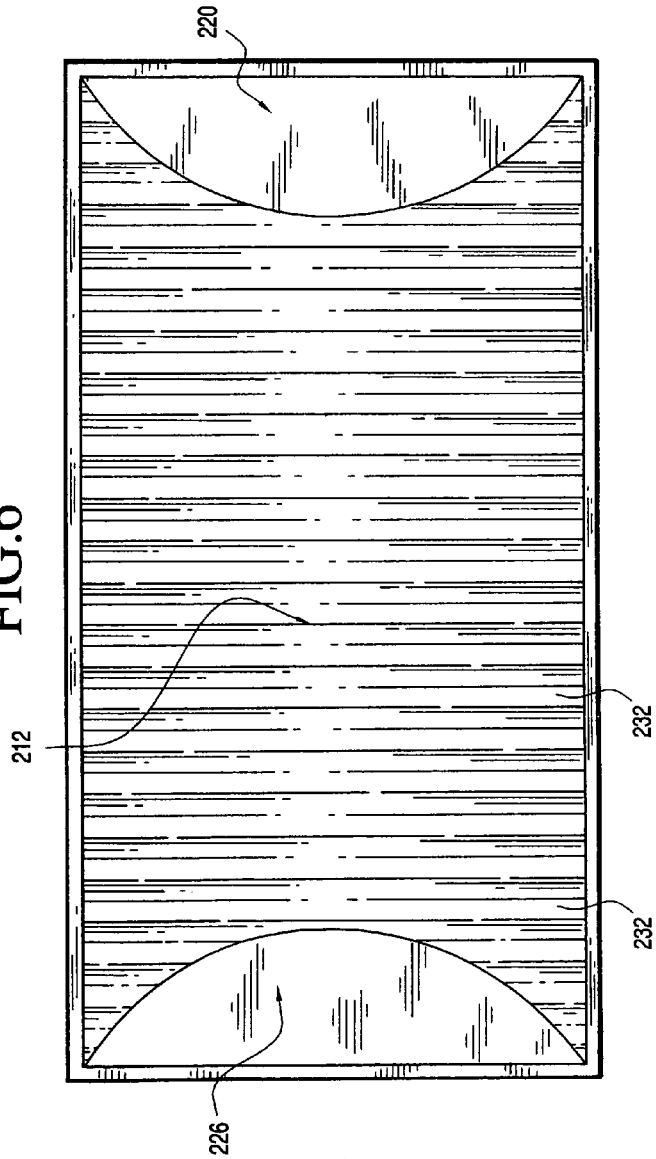
FIG. 6 is a top view of an alternative embodiment of a skylight made in accordance with this invention.

FIGS. 6-8 show a skylight 210, which is an alternative embodiment made in accordance with this invention. Skylight 210 includes a main body 212, a first end portion 220, a second end portion 226, and corrugations 232. This alternative embodiment is similar to the exemplary embodiment shown in FIGS. 1-5 and 21 except that there are more corrugations 232 spanning main body 212 than in main body 12 of the first exemplary embodiment. Another difference is that corrugations 232 are shaped generally as sinusoidal waves.

Figure 10:
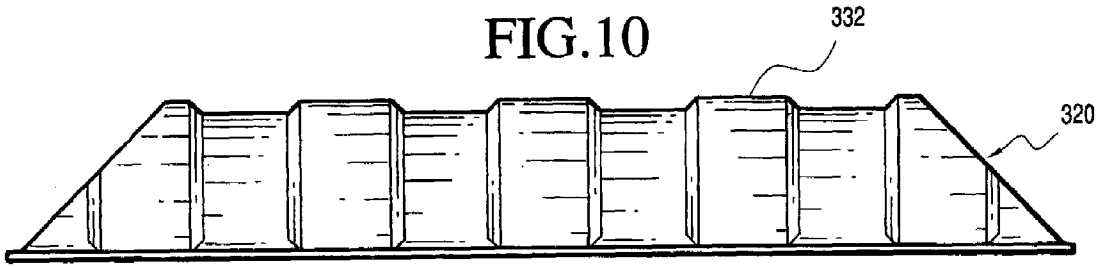
FIG. 10 is a side view of the skylight of FIG. 9.
Figure 9:
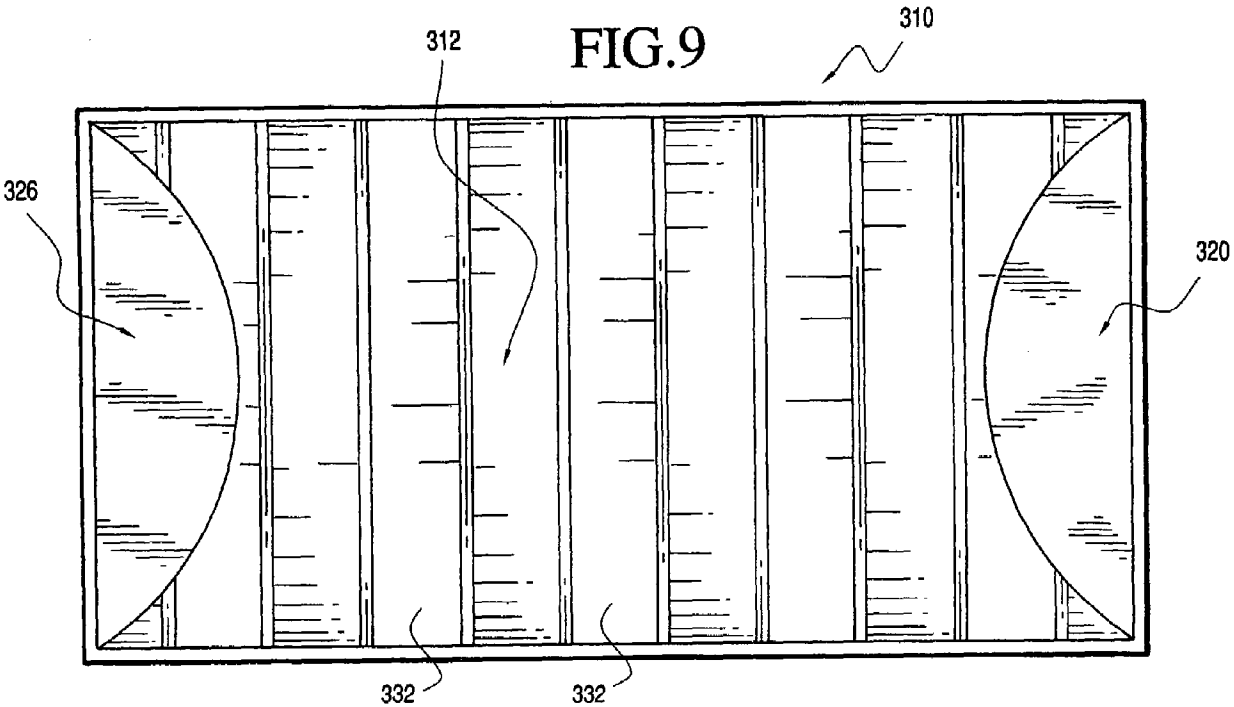
FIG. 9 is a top view of another alternative embodiment of a skylight made in accordance with this invention.
Figure 11:
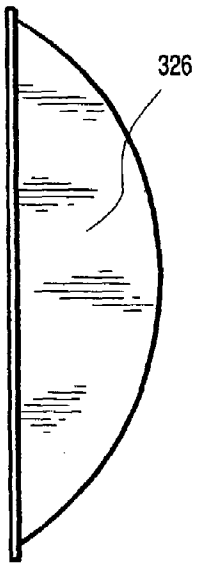
FIG. 11 is an end view of the skylight of FIG. 9.

FIGS. 9-11 show a skylight 310, which is an alternative embodiment made in accordance with this invention. Skylight 310 includes a main body 312, a first end portion 320, a second end portion 326, and corrugations 332. This alternative embodiment is similar to the exemplary embodiment shown in FIGS. 1-5 and 21 except that there are fewer corrugations 332 spanning main body 312 than in main body 12 of the first exemplary embodiment. Another difference is that corrugations 332 are shorter and wider than corrugations 32 of the first exemplary embodiment.

Figure 13:
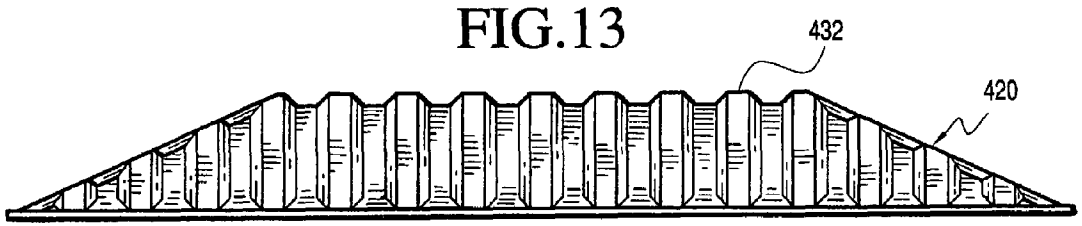
FIG. 13 is a side view of the skylight of FIG. 12.
Figure 12:
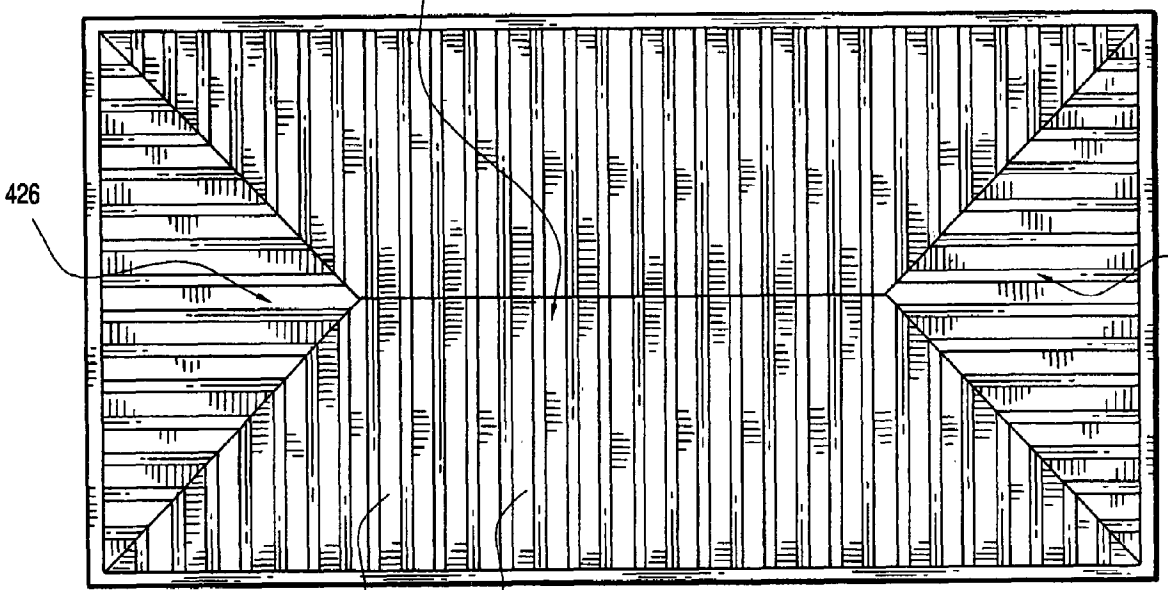
FIG. 12 is a top view of yet another alternative embodiment of a skylight made in accordance with this invention.
Figure 14:
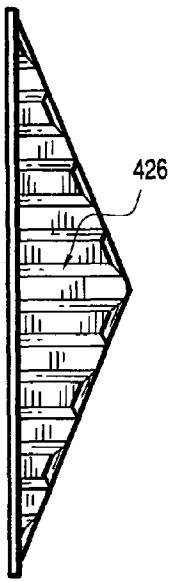
FIG. 14 is an end view the skylight of FIG. 12.

FIGS. 12-14 show a skylight 410 that is an alternative embodiment made in accordance with this invention. Skylight 410 includes a main body 412, a first end portion 420, a second end portion 426, and corrugations 432. This alternative embodiment is similar to the exemplary embodiment shown in FIGS. 1-5 and 21 except that there are fewer corrugations 432 spanning main body 412 than in main body 12 of the first exemplary embodiment. Another difference is that the arch of main body 412 is generally V-shaped.

Figure 16:
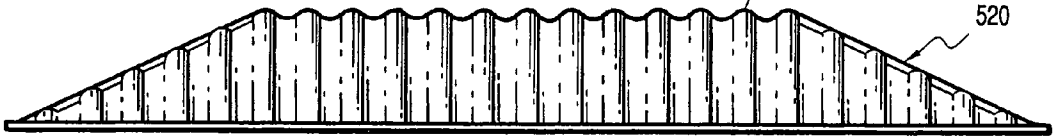
FIG. 16 is a side view of the skylight of FIG. 15.
Figure 15:
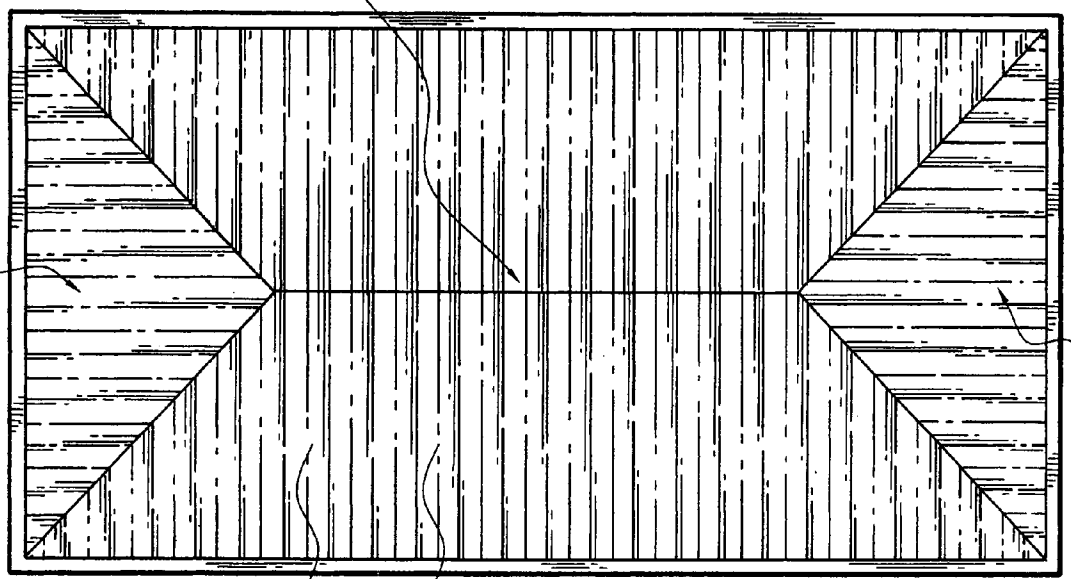
FIG. 15 is a top view of another alternative embodiment of a skylight made in accordance with this invention.
Figure 17:
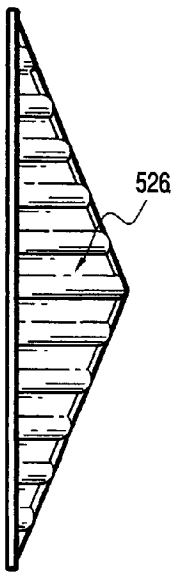
FIG. 17 is an end view of the skylight of FIG. 15.

FIGS. 15-16 show a skylight 510 that is an alternative embodiment made in accordance with this invention. Skylight 510 includes a main body 512, a first end portion 520, a second end portion 526, and corrugations 532. This alternative embodiment is similar to the exemplary embodiment shown in FIGS. 1-5 and 21 except that there are fewer corrugations 532 spanning main body 512 than in main body 12 of the first exemplary embodiment. Another difference is that the arch of main body 512 is generally V-shaped.

Figure 20:
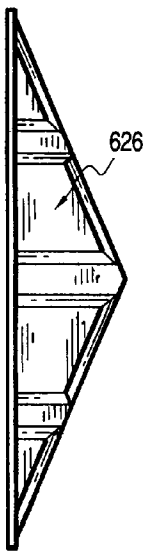
FIG. 20 is an end view of the skylight of FIG. 18.
Figure 19:
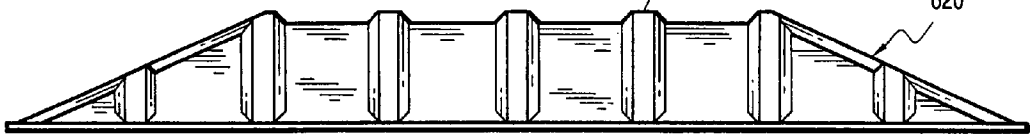
FIG. 19 is a side view of the skylight of FIG. 18.
Figure 18:
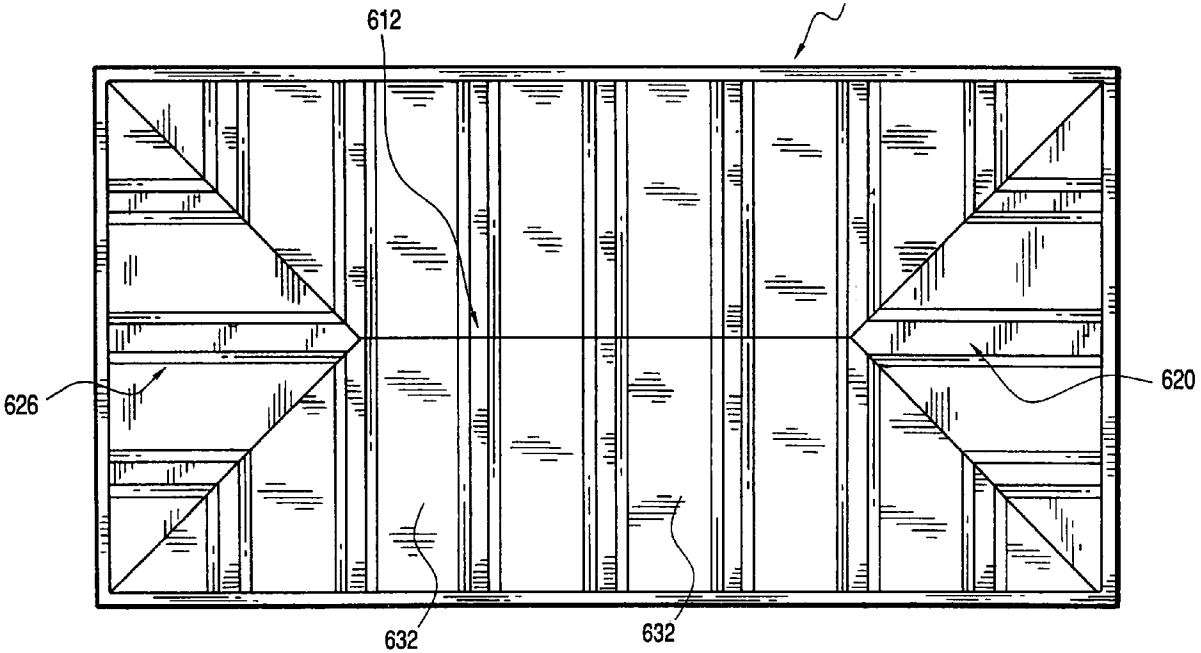
FIG. 18 is a top view of still yet another alternative embodiment of a skylight made in accordance with this invention.

FIGS. 18-20 show a skylight 610 that is an alternative embodiment made in accordance with this invention. Skylight 610 includes a main body 612, a first end portion 620, a second end portion 626, and corrugations 632. This alternative embodiment is similar to the exemplary embodiment shown in FIGS. 1-5 and 21 except that there are fewer corrugations 632 spanning main body 612 than in main body 12 of the first exemplary embodiment. Another difference is that the arch of main body 612 is generally V-shaped.

It will be understood that the present invention provides a highly efficient skylight that increases the transmission of light through the skylight, increases heat dissipation, and increases the structural integrity of the skylight.

The foregoing description of a preferred embodiment of the invention has been presented for purposes of illustration and description. It is not intended to be exhaustive or to limit the invention to the precise form disclosed. Obvious modifications, variations or combination of embodiments are possible in light of the above teachings. The exemplary embodiments were chosen and described to provide an illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

While this invention has been described in conjunction with the specific embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of this invention.

What is claimed is:

1. A window comprising a building skylight adapted to be attached to the roof of a building, wherein the building skylight comprises:

a main body being arched in the shape of a parabola or a V and having an apex, a base, a first length at substantially the apex and a second length at the base, wherein the first length is less than the second length;

first and second end portions being disposed at first and second ends of the main body, respectively, each of the end portions having a top section and a bottom section, wherein the top sections define the first length and the bottom sections define the second length; and a corrugation disposed on the main body, wherein at least one of the end portions slopes toward the apex at an angle of between about 35 and about 65 degrees relative to the base.

2. The window of claim 1, wherein the angle is about 45 degrees.

3. The window of claim 1, wherein the corrugation is semi-hexagonally shaped.

4. The window of claim 3, wherein the corrugation comprises two planar sides and a planar top surface.

5. The window of claim 4, wherein at least one of the two planar sides slopes toward a midpoint of the corrugation at an angle of about 45 degrees.

6. The window of claim 1, wherein the corrugation has a generally sinusoidal shape.

* * * * *